US007698074B1

(12) United States Patent
Cybulski

(10) Patent No.: US 7,698,074 B1
(45) Date of Patent: Apr. 13, 2010

(54) EMISSION MONITORING METHODS AND SYSTEMS

(75) Inventor: Michael Cybulski, 3311 Jan Ct., Katy, TX (US) 77493

(73) Assignee: Michael Cybulski, Katy, TX (US)

( * ) Notice: Subject to any disclaimer, the term of this patent is extended or adjusted under 35 U.S.C. 154(b) by 0 days.

(21) Appl. No.: 11/600,621

(22) Filed: Nov. 16, 2006

(51) Int. Cl.
*G01N 31/00* (2006.01)

(52) U.S. Cl. ..... 702/32; 702/22

(58) Field of Classification Search ..... 702/22–24, 702/30–32, 60–62, 122, 179, 181–183, 189; 701/29, 32; 73/23.37, 23.42; 340/443; 423/212
See application file for complete search history.

(56) References Cited

U.S. PATENT DOCUMENTS 5,548,528 A * 8/1996 Keeler et al. ..... 702/22
5,970,426 A * 10/1999 Mandel et al. ..... 702/32
6,732,055 B2 * 5/2004 Bagepalli et al. ..... 702/32

* cited by examiner

*Primary Examiner*—John H Le

(57) ABSTRACT

Methods and systems are disclosed for determining emission outputs. One method bypasses a predictive emission function whenever an operating level is the same as an operating level from the original training set, and reports the emission level ascertained by the EPA reference method test during original training set acquisition. Another method uses a Predictive Emission Monitoring System to replace a Continuous Emission Monitoring System for cost effective management of pollution control equipment.

1 Claim, 3 Drawing Sheets

EMISSION MONITORING METHODS AND SYSTEMS

CROSS-REFERENCES TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPUTER DISC

Not applicable

BACKGROUND OF THE INVENTION

1. Field of the Invention

This invention generally relates to air quality management and more particularly to methods and systems for monitoring and predicting emissions outputs from emission sources more accurately then the present art.

The United States Congress requires reductions in actual emissions of several hazardous air pollutants. See Clean Air Act Title IV (Acid Rain Program).sctn.7651 (West 1995 & Supp. 2000). Congress requires that any operator of an emissions source, subject to laws, must sample the emissions source and record such emissions as sulfur dioxide and nitrogen oxide emissions. The record of these emissions must be submitted to the EPA (for Environmental Protection Agency).

Sampling and reporting these emissions, however can be a slow, cumbersome, and expensive task. Emissions monitoring equipment CEMS (for continuous emission monitoring system), is an emission sensing device required by congress, can cost up to $200,000. One CEMS is often required for each source so an industrial process with multiple sources can require a million dollars or more in emission monitoring equipment. This emissions monitoring equipment also has a high installation cost and high maintenance cost. There are also long lead times and high labor costs in gathering this emissions data and in presenting the data in a format required by the EPA. Once this emission data is gathered and reported added expenses are incurred to archive thousands of pages of emissions documents and regulatory submissions. However despite all this, a CEMS is preferred over a PEMS (for predictive emission monitoring system) because of its increased accuracy.

A similar problem occurs with pollution control equipment. These units require the knowledge of the pollution levels of the pollution emitting equipment they are functioning for. Currently they use CEMS to regulate them to the optimal level for reducing pollution.

There is accordingly a need in the art for methods and systems of inexpensively monitoring source emissions, for methods and systems to inexpensively predicting source emissions, for methods and systems of gathering, formatting and reporting emission data to regulatory agencies, for assisting pollution control equipment and a system for buying and selling emission allowances. There is a need in the art to have a PEMS that does not estimate pollution levels that are being emitted when a pollution source is operating at full capacity and near its permitted level. Estimating a pollutant level at this point, even with a small degree of error, can put the emission source in violation of its permit when in fact it was in compliance.

There is accordingly a need in the art to have the PEMS accurately reflect the emission determinations that the EPA reference method tests would have derived. There is a need to have a PEMS not estimate emissions at every operating level. This invention has a PEMS not estimate emissions at certain operating levels, but instead give actual emission values derived from EPA reference method tests.

2. Description of Related Art Including Information Disclosed Under 37 CFR 1.97 and 1.98

Emission sources which could use a CEMS or PEMS have an air permit given to them by a government agency which states what is the maximum allowable emissions level it may emit. Certain air permits have written in emission levels that are greater than the highest emission level which that emission source can emit. Those emission sources can use prior art.

There are emission sources with air permits which have maximum allowable emission rates equal to or nearly equal to the emission rates that are frequently produced by the emission source. These emission sources may experience difficulty with prior art. Prior art estimates emission values. However when these emission sources were operating at its maximum emission level the prior art would sometimes estimate an emission level that was slightly higher than the actual level ascertained by an EPA reference method test. This meant a violation of a permit when in fact there was no violation.

This invention would take the actual emission level ascertained by an EPA reference method test and use that value when an emission source was operating at its maximum emission level.

Prior art estimated emission levels through an algorithm such as a neural net, or a regression analysis or a hybrid of these mathematical tools. The one common element in emission values of prior art is that every emission level produced by prior art is an estimated emission level. Prior art limited the use of PEMS to estimating emission levels at every operating level of the pollution emitting devise it was used on.

Prior art recognizes that its results will not exactly match that of an EPA reference method test. This invention's advantage is that in many of the operating levels of the source of emissions it precisely matches the actual pollutant level. It is exactly equal with no differences from the EPA reference method test.

Like prior art this PEMS has a sensor validation and like prior art it must initially go through a training process and periodically go through a retraining process.

Prior art saw the need for a PEMS as a back up to CEMS, should the CEMS malfunction. Prior art did not seek to improve the accuracy of PEMS in this combination. However a new use for PEMS is that of managing or assisting pollution control equipment. Prior art did increase the use of PEMS beyond that of just calculating emission values and did use PEMS as a device to ascertain when a CEMS was inoperable. However prior art failed to see its use in assisting a pollution control device. A CEMS senses pollution and merely reports pollution levels but a pollution control device seeks to reduce pollution levels.

BRIEF SUMMARY OF THE INVENTION

This invention increases the accuracy of the prior art and makes it accurately reflect the emissions numbers that would have been derived by an EPA reference method test. The limitations in prior art was that deriving an emission level that is somewhat close to the actual pollutant level will not work on plants that run at levels equal to their permit level. They require a monitoring system with as little or no error as possible.

This invention takes the actual emission levels derived from EPA reference method tests whenever possible and reports that number. Only when the pollution emitting equipment is operating in a set of operating parameters which were not part of the original sets used to train the PEMS algorithm does the predictive function operate as a standard PEMS.

This invention also applies the use of PEMS to help assist pollution control equipment. It takes advantage of the cost savings of PEMS over CEMS.

BRIEF DESCRIPTION OF THE SEVERAL VIEWS OF THE DRAWINGS

FIG. 1 is a block diagram showing the Emissions Monitoring Module 20 residing in a computer system 22. The Emissions Monitoring Module 20 may be stored within a system memory device 24. The computer system 22 also has a central processor 26 executing an operating system 28. The operating system 28 also resides within the system memory device 24. The operating system 28 has a set of instructions that control the internal functions of the computer system 22. A system bus 30 communicates signals, such as data signals, control signals, and address signals, between the central processor 26, the system memory device 24, and at least one peripheral port 32. Those skilled in the art understand that the program, processes, methods, and systems described in this patent are not limited to any particular computer system or computer hardware.

Figure 1:
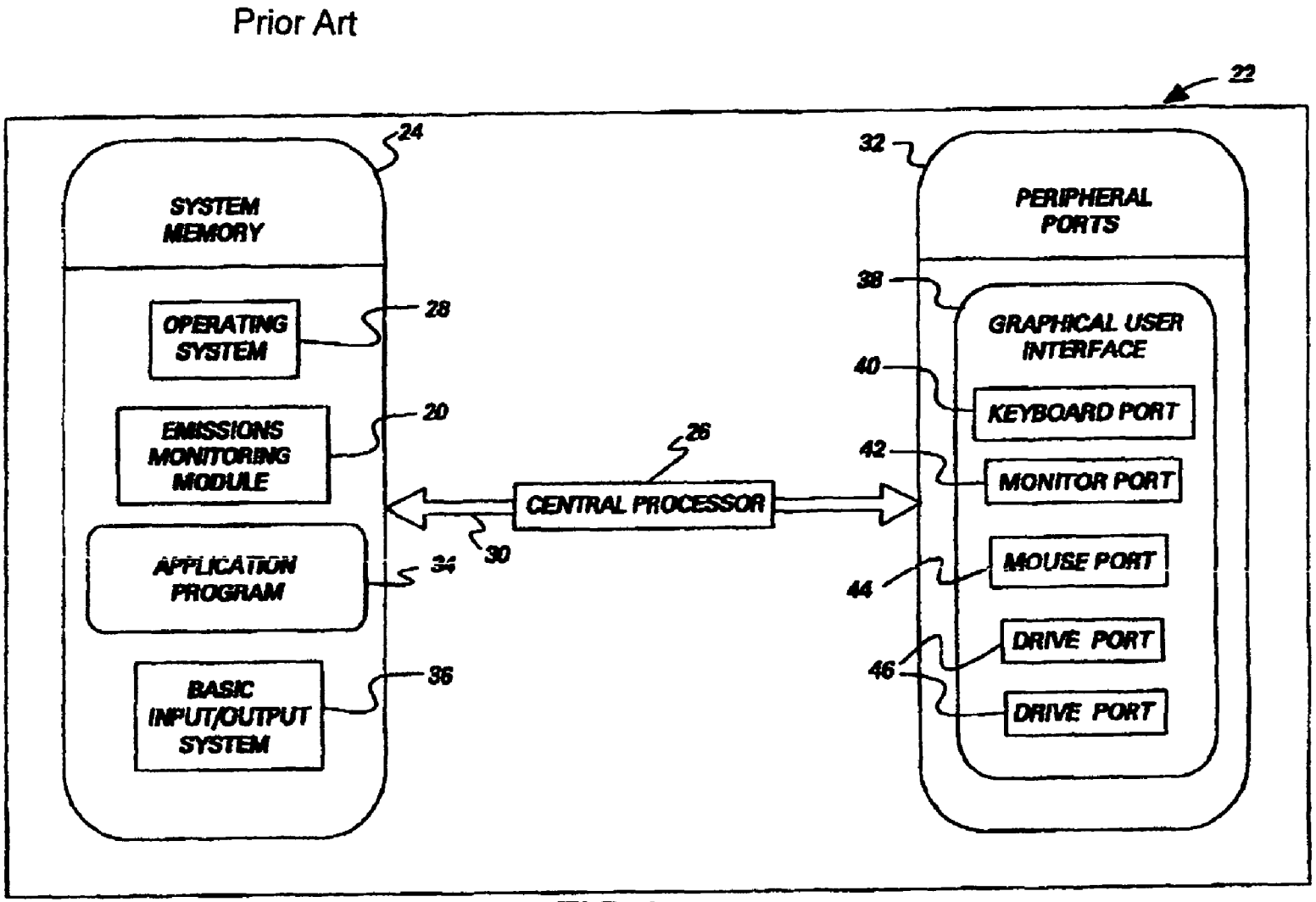
FIG.1 Prior Art
FIGS. 1 and 2 depict a possible computer operating environment for an embodiment of the present invention. This embodiment of an Emissions Monitoring Module 20 comprises a computer program that acquires information and predicts pollutant emissions or gives actual emission levels. As those skilled in the art of computer programming recognize, computer programs are depicted as process and symbolic representations of computer operations. Computer components, such as a central processor, memory devices, and display devices, execute these computer operations. The computer operations include manipulation of data bits by the central processor, and the devices maintain the data bits in data structures. The process and symbolic representations are understood, by those skilled in the art of computer programming, to convey the discoveries in the art.

Those skilled in art also understand the central processor 26 is typically a microprocessor. Advanced Micro Devices, Inc., for example, manufactures a full line of ATHLON™ microprocessors (ATHLON™ is a trademark of Advanced Micro Devices, Inc., One AMD Place, P.O. Box 3453, Sunnyvale, Calif. 94088-3453, 408.732.2400, 800.538.8450). The Intel Corporation also manufactures a family of X86 and P86 microprocessors (Intel Corporation, 2200 Mission College Blvd., Santa Clara, Calif. 95052-8119, 408.765.8080). Other manufacturers also offer microprocessors. Such other manufacturers include Motorola, Inc. (1303 East Algonquin Road, P.O. Box A3309 Schaumburg, Ill. 60196), International Business Machines Corp. (New Orchard Road, Armonk, N.Y. 10504, (914) 499-1900), and Transmeta Corp. (3940 Freedom Circle, Santa Clara, Calif. 95054). While only one microprocessor is shown, those skilled in the art also recognize multiple processors may be utilized. Those skilled in the art further understand that the program, processes, methods, and systems described in this patent are not limited to any particular manufacturer's central processor.

The system memory 24 also contains an application program 34 and a Basic Input/Output System (BIOS) program 36. The application program 34 cooperates with the operating system 28 and with the at least one peripheral port 32 to provide a Graphical User Interface (GUI) 38. The Graphical User Interface 38 is typically a combination of signals communicated along a keyboard port 40, a monitor port 42, a mouse port 44, and one or more drive ports 46. The Basic Input/Output System 36, as is well known in the art, interprets requests from the operating system 28. The Basic Input/Output System 36 then interfaces with the keyboard port 40, the monitor port 42, the mouse port 44, and the drive ports 46 to execute the request.

The operating system 28 is WINDOWS® (WINDOWS® is a registered trademark of Microsoft Corporation, One Microsoft Way, Redmond Wash. 98052-6399, 425.882.808). WINDOWS® is typically preinstalled in the system memory 24. Those skilled in the art also recognize many other operating systems are suitable, such as UNIX® (UNIX® is a registered trademark of the Open Source Group), Linux, and Mac® OS (Mac® is a registered trademark of Apple Computer, Inc., 1 Infinite Loop, Cupertino, Calif. 95014, 408.996.1010). Those skilled in the art again understand that the program, processes, methods, and systems described in this patent are not limited to any particular operating system.

Figure 2:
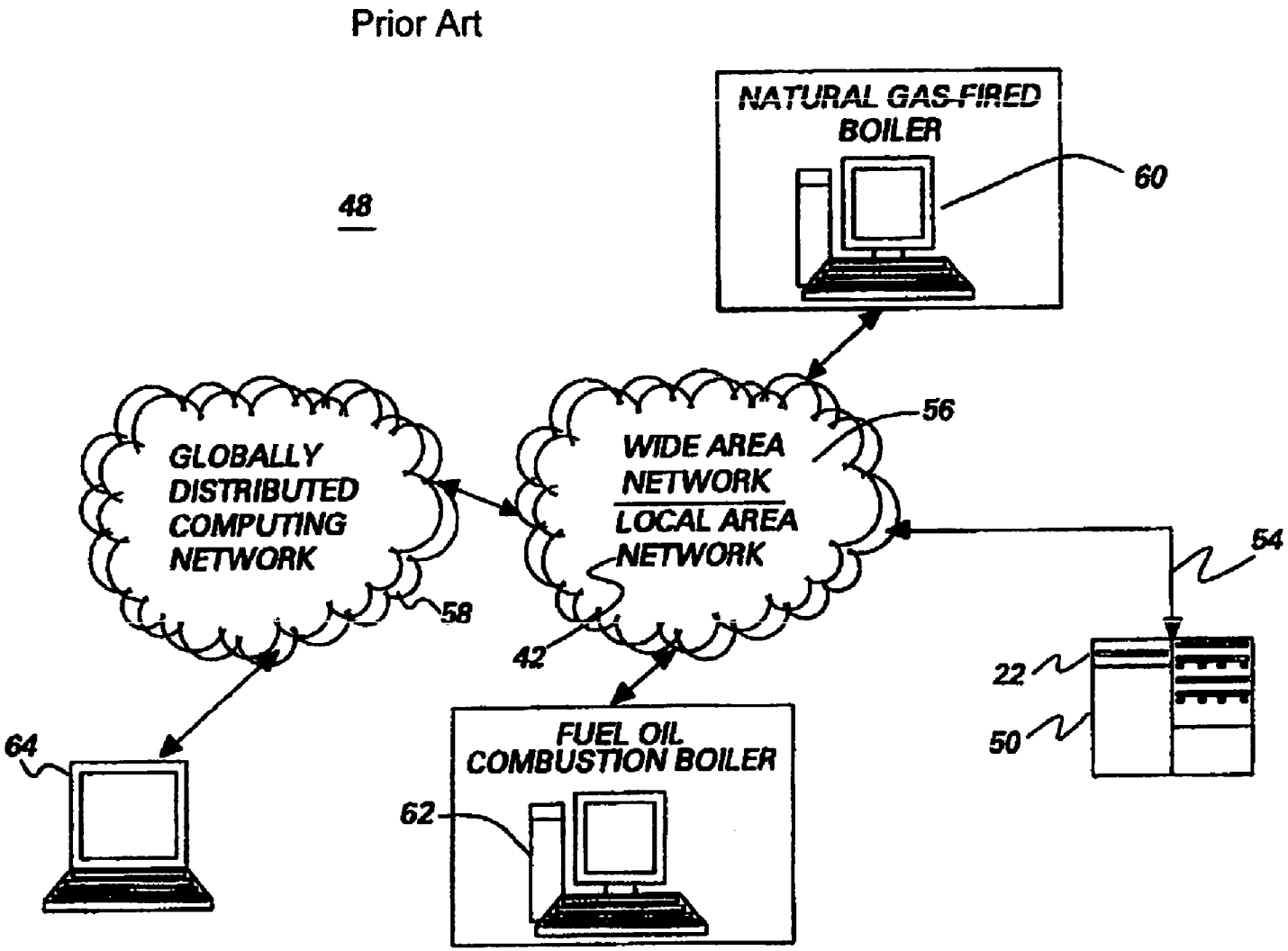
Prior Art FIG. 2

FIG. 2 is a block diagram of a communications network 48. This communications network 48 further represents an operating environment for the Emissions Monitoring Module (shown as reference numeral 20 in FIG. 1). The Emissions Monitoring Module resides within the memory storage device (shown as reference numeral 24 in FIG. 1) in the computer system 22. The computer system 22 is shown as a server 50. The server 50 may communicate with a Local Area Network (LAN) 52 along one or more data communication lines 54 or via wireless interfaces. As those of ordinary skill have long understood, the Local Area Network 52 is a grid of communication lines through which information is shared between multiple nodes. These multiple nodes are conventionally described as network computers. As those of ordinary skill in the art also recognize, server 50 could also communicate with a Wide Area Network (WAN) 56 and with a globally distributed computing network 58 (the "Internet"). The communications network 48 allows the server 50 to request and to acquire information from many other computers connected to the Local Area Network 52, the Wide Area Network 56, and the globally distributed computing network 58.

As FIG. 2 shows, the server 50 may request and acquire information from many computers connected to the communications network 48. The server 50, for example, may acquire information from a boiler computer 60 monitoring a natural gas-fired boiler. The boiler computer 60 commonly monitors the rate of usage of natural gas by the boiler. The rate of usage of natural gas is commonly measured by a flow meter, and the flow meter is then monitored by the boiler computer 60. The boiler computer 60, in some instances, may sample emissions from the natural gas-fired boiler. Such emissions may include, but are not limited to, nitrogen oxides (NO.sub.X), carbon monoxide (CO), carbon dioxide (CO-.sub.2), methane (CH.sub.4), nitrous oxide (N.sub.2O), sulfur dioxide (SO.sub.2), volatile organic compounds, and particulate matter. The server 50 could also acquire information from a fuel oil operation computer 62 monitoring a fuel oil combustion boiler. The fuel oil operation computer may monitor emissions and fuel oil usage of the fuel oil combustion boiler. FIG. 2 also shows that remote users, such as environmental engineers, Environmental Protection Agency regulators, and plant operators, may use a remote computer 64 to access the communications network 48 and to remotely access the server 50. Because many computers may be connected to the communications network 48, computers and computer users may share and communicate a vast amount of information acquired and processed by the Emissions Monitoring Module. The Emissions Monitoring Module thus permits on-line, real-time energy and emissions monitoring.

Figure 3:
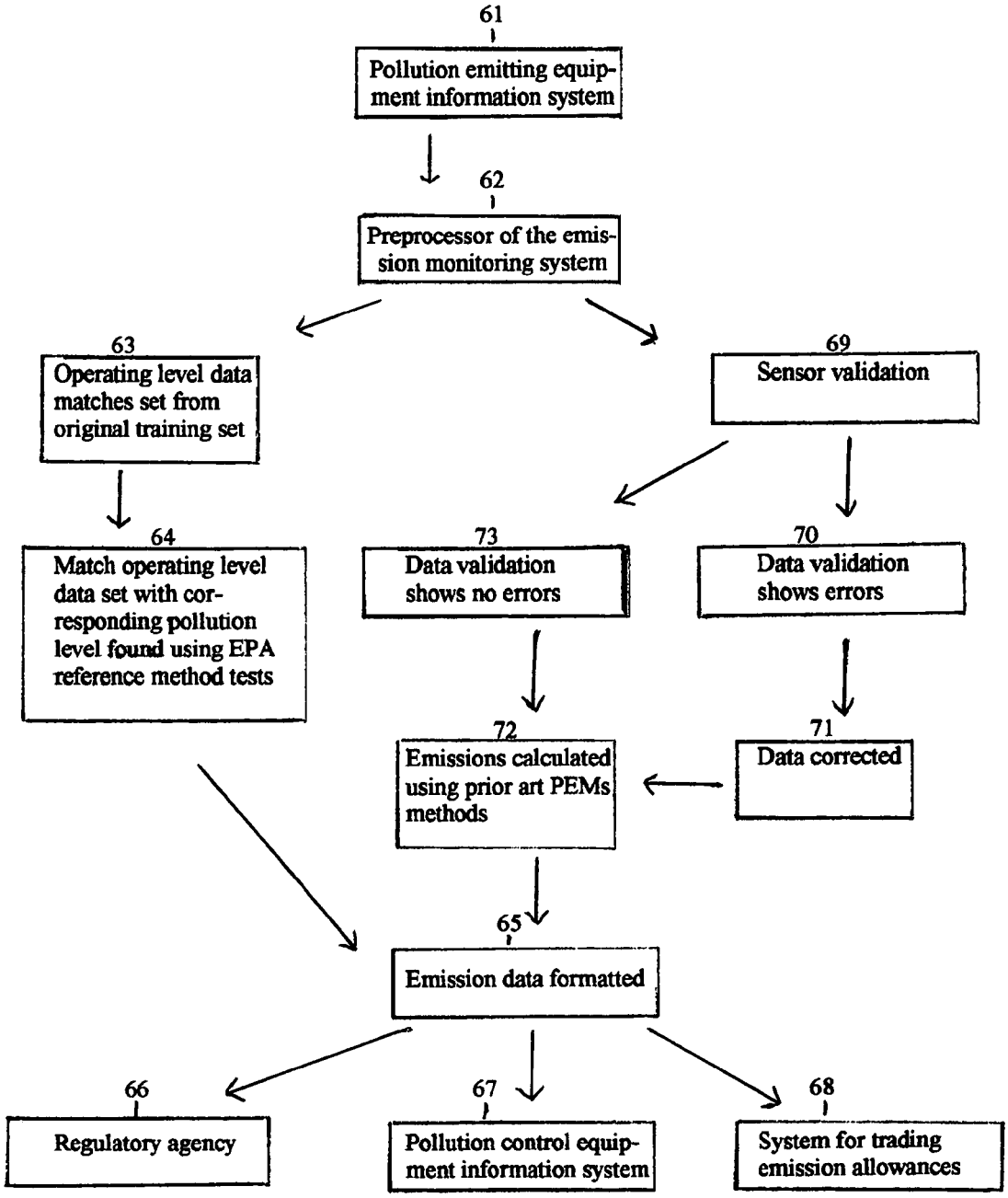

FIG. 3 is a diagram describing one embodiment of the emissions monitoring method or system. An information system of a pollution emitting equipment 61 communicated with the emission monitoring module preprocessor 62. The preprocessor function is to determine if the set of operating level data matches that of an original set of operating level data from that of a training set. If it does match 63 a set from a original training data, then this set is then matched with the pollution level ascertained from the EPA reference method test, which are the actual emissions, a predictive emission function is bypassed whenever possible for the more accurate EPA reference test results 64 and once complete is sent to have that emission data formatted 65 for whatever use it may have; be if for a regulatory agency 66, a pollution control equipment information system 67, or a system for buying and selling emission allowances 68. If the set of operating level data does not match that from the original set of training data then the invention reacts just as those of the prior art. It is first sent to a sensor validation 69 phase and then if any of the sensor values are found to be incorrect 70, those particular sensor values are corrected 71 and the data is sent to a trained network or mathematical model 72 to predict the emission level. If all sensor values are correct 73 it is then sent to a trained network or mathematical model 72 to predict the emission level. Once this emission level is predicted that data is then formatted 65 for whatever use is required, be it a regulatory agency 66, a pollution control equipment information system 67, or a system for buying and selling emission allowances 68.

Therefore the preprocessor function 62, 63, 64 is the improvement to a PEMS described in this invention. PEMS are well known and for the purpose of this invention need not be described in detail.

And the communicating the emissions data from a PEMS to a pollution control equipment information system, as a replacement for a CEMS, is the secondary claim of this invention.

Although the present invention has been described with reference to preferred embodiments, workers skilled in the art will recognize that changes may be made in form and detail without imparting from the spirit and scope of the invention.

DETAILED SUMMARY OF THE INVENTION

The present invention disclosed and claimed herein comprises a system and method for monitoring select operating parameters of a pollution emitting equipment that are output as a by product of the operation of that equipment, the equipment having control values to alter the operation of the equipment and sensors to measure the operating parameters of the equipment and output associated sensor values.

EPA reference method tests are provided for measuring the pollutant levels at various operating levels of the equipment for the purpose of building a representative algorithm such as a mathematic model or training a network.

An equipment information system is provided for measuring the control values of the equipment and the sensor values of the equipment on a frequent basis.

A virtual sensor predictive network or mathematical model is provided which contains a stored representation of the equipment and has as an output there a predicted select operating parameter level that corresponds to the actual level of the select operating parameters determined by the measurement devise to be output by the equipment. The control values of the equipment and the sensor values of the equipment from the equipment information system comprise inputs to the virtual sensor predictive algorithm.

The stored representation in the virtual sensor predictive mathematical model or network is learned from the levels of the select operating parameters and the associated control values and sensor values that exist during the time that the levels of the set of operating parameters were measured. This measured select operating parameter level is measured in accordance with a predetermined process. The virtual sensor predictive mathematical model or network has a preprocessor function that checks the levels of the set of operating parameters to ascertain if they are identical to any of a set of operating parameters that had EPA reference method tests performed on them. If a match is ascertained, then instead of inputting this set into a virtual sensor predictive mathematical model or network, the system takes the actual pollutant level ascertained by the EPA reference method tests and reports that number, which is the actual emissions, therefore the predictive emission function is bypassed whenever possible so that the actual emissions can be reported.

The invention claimed is:

1. A method of determining emissions comprising:

a. obtaining operational control value data;

b. using a preprocessor for preprocessing said operational control data to ascertain if said operational control data matches that from a group of data from an original training set; whenever there is a match, report the emission level ascertained by an environmental protection agency reference test which are the actual emission levels during the training;

c. using a predictive emissions monitoring system for predicting emissions relating to said operational control value data that does not match a set from said original training set;

d. wherein a predictive emission function is bypassed whenever possible for the more accurate EPA reference test results.

* * * * *